US005209485A

United States Patent [19]

Nesbitt et al.

[11] Patent Number: 5,209,485

[45] Date of Patent: May 11, 1993

[54] RESTRICTED FLIGHT GOLF BALL

[75] Inventors: R. Dennis Nesbitt, Westfield, Mass.; Terence Melvin, Somers, Conn.

[73] Assignee: Lisco, Inc., Tampa, Fla.

[21] Appl. No.: 763,895

[22] Filed: Sep. 23, 1991

[51] Int. Cl.[5] ..... A63B 37/00; A63B 37/14; A63B 37/12

[52] U.S. Cl. ..... 273/218; 273/235 R; 273/232; 273/199 R

[58] Field of Search ..... 273/218, 235 R, 235 A, 273/235 B, 199 R, 199 A, 220, 230, 62

[56] References Cited

U.S. PATENT DOCUMENTS

| | | | |
|---|---|---|---|
| 3,784,209 | 1/1974 | Berman | 273/218 |
| 4,274,637 | 6/1981 | Molitor | 273/235 R |
| 4,770,422 | 9/1988 | Isaac | 273/218 |
| 4,836,552 | 6/1989 | Purkett et al. | 273/218 |
| 4,911,451 | 3/1990 | Sullivan et al. | 273/235 R |
| 4,919,434 | 4/1990 | Saito | 273/218 X |
| 5,018,740 | 5/1991 | Sullivan | 273/218 X |
| 5,150,906 | 9/1992 | Molitor et al. | 273/235 R X |

FOREIGN PATENT DOCUMENTS

| | | | |
|---|---|---|---|
| 197804 | 4/1978 | United Kingdom | 273/218 |

*Primary Examiner*—George J. Marlo

[57] ABSTRACT

The present invention is directed to restricted or limited flight golf balls. Specifically, new elastomeric blends are provided for forming the cores of one piece or multi-layered balls having the desired reduced coefficient of restitution (C.O.R.) values necessary for restrictive flight performance (i.e. elastomeric blends having C.O.R. values when cured of about 0.560 to about 0.670, with C.O.R. values of about 0.560 to about 0.640 being preferred for the core composition of multi-layered restricted flight golf balls). This is accomplished utilizing the elastomeric blends of the invention without sacrificing the compression (hardness), weight and feel of the resulting cured product.

The core compositions can be coated with standard cover stock compositions and/or additional layered compositions when utilized for the formation of multi-layered balls and/or configured with an inefficient dimple pattern to provide restricted flight golf balls having carrying distances about 45–50 yards shorter than that of standard range balls.

12 Claims, 5 Drawing Sheets

RESTRICTED FLIGHT GOLF BALL

BACKGROUND OF THE INVENTION

The present invention is directed to golf balls, and in particular, to restricted flight (or limited flight) golf balls. The golf balls of the present invention are designed to travel a distance that is shorter than the distance travelled by standard golf balls. This is accomplished through the use of an inefficient dimple pattern and/or elastomeric compositions having reduced coefficient of restitution (C.O.R.) values in comparison with balls constructed of conventional elastomeric blends. The balls are durable, have good click and feel characteristics, and with the exception of exhibiting the restricted or limited flight performance, have performance characteristics comparable to that of conventional golf balls.

Restricted flight golf balls are desirable for a number of reasons. For instance, they are less likely to be hit over a driving range retaining wall or fence. This factor alone increases the safety of those who are located just outside the retaining wall, and also assists in preventing the balls from becoming lost. Also, more compact driving ranges and golf courses can be developed in areas of high real estate values and/or high population densities.

In reducing the distance a golf ball will travel when hit, there are a variety of factors which are to be considered. The coefficient of restitution, along with ball size, weight and additional factors such as club head speed, angle of trajectory, and ball aerodynamics (i.e., dimple pattern), generally determine the distance a ball will travel when hit. Since club head speed and the angle of trajectory are not factors easily controllable, particularly by golf ball manufacturers, the factors of concern among manufacturers are the coefficient of restitution and the surface dimple pattern of the ball.

A golf ball's coefficient of restitution (C.O.R.) is the ratio of the relative velocity of the ball after direct impact to that before impact. One way to measure the coefficient of restitution is to propel a ball at a given speed against a hard massive surface, and measure its incoming velocity and outgoing velocity. The coefficient of restitution is defined as the ratio of the outgoing velocity to incoming velocity of a rebounding ball and is expressed as a decimal. As a result, the coefficient of restitution can vary from zero to one, with one being equivalent to an elastic collision and zero being equivalent to an inelastic collision.

The coefficient of restitution of a one-piece golf ball is a function of the ball's composition. In a two-piece or a multi-layered golf ball, the coefficient of restitution is a function of the core, the cover and any additional layer. While there are no United States Golf Association (U.S.G.A.) limitations on the coefficient of restitution values of a golf ball, the U.S.G.A. requires that the golf ball cannot exceed an initial velocity of 250 $\pm/-5$ feet/second. As a result, golf ball manufacturers generally seek to maximize the coefficient of restitution of a ball without violating the velocity limitation.

The present invention is directed to the production of restricted or limited flight golf balls through the use of inefficient dimple patterns and/or low coefficient of restitution elastomer compositions. No U.S.G.A. limitations exist in regard to the minimal coefficient of restitution and/or velocity of a golf ball, particularly for driving range balls and/or practice balls, the specific subject matter of the present invention.

In this regard, it has been found by the inventors that by reducing the coefficient of restitution of a standard traditional flight golf ball from around 0.800 to around 0.560, about a 50 yard reduction in carrying distance can be achieved. Such a low C.O.R., however, is generally undesirable because it causes the ball to feel too "dead" when hit. It has also been found that the projection or lift of such a low C.O.R. ball cannot be greatly enhanced even with the incorporation with specialty design dimple patterns. As a result, such low C.O.R. balls do not exhibit the playability characteristics of a conventional golf ball.

Certain competitive one piece restricted flight range balls exist exhibiting reduced PGA compression. Whereas top grade golf balls are 100 PGA compression, these prior art restricted flight range balls are 60 PGA compression (i.e. approximately 0.095 in Riehle compression). However, these low compression balls feel soft or "mushy" and do not have desired click or feel exhibited by the present invention. See, for example ball "D" in Example 1 below. Also, these balls have C.O.R. values of around 0.685, which is greater than the C.O.R.'s of the present invention, and as such do not provide a sufficiently limited distance.

Another more established method for decreasing the distance travelled by a golf ball is to reduce the ball's weight. See, for example, U.S. Pat. No. 4,839,116. In this regard, golf balls having micro-balloons or microscopic glass bubbles inside the core component of the balls to reduce weight are known in the art. However, weight reduction, as with reducing the coefficient of restitution to the above-described low values, is undesirable. If a ball with a given dimple pattern is too light in weight, it will fly too high in trajectory. Also, the ball's feel, as well as its wind stability, are adversely affected.

Moreover, reducing a ball's weight increases the cost of manufacturing the ball in that the standard inexpensive heavy mineral fillers are used to a lesser extent or not at all. Thus, such light weight balls are not particularly desirable.

One object of the present invention is to provide novel and improved elastomeric cores or centers useful for the construction of solid one-piece or multi-layered golf balls having lower coefficient of restitution values. Another object is to provide golf balls which, because of their core or center composition, exhibit reduced driving distance without sacrificing desirable playability aspects of the golf balls, such as compression, weight and feel, upon club head impact. The overall performance characteristics of the balls of the invention are, with the exception of the restricted flight characteristics, essentially the same as conventional golf balls.

An additional object of the present invention is to develop a golf ball that is approximately 45–50 yards shorter in total distance off a driver than the longest range ball sold by Spalding & Evenflo Companies, Inc. (i.e. Spalding's "Super Range") without affecting the balls size, weight or compression. This is accomplished by combining an inefficient dimple pattern with elastomeric compositions C.O.R. values of about 0.560 to about 0.670, with C.O.R. values for the core compositions of multi-layered restrictive flight golf balls of about 0.560–0.640 being more preferred).

Specifically, the reduction in C.O.R. values has been achieved by the development of an elastomeric compositions which, when utilized in the construction of one-piece golf balls or supplemented with resinous cover stock formulations and/or additional core components for the construction of multi-layered balls, and configured with an inefficient dimple pattern, form restricted flight driving range golf balls that have trajectories similar to that of conventional golf balls.

These and other objects and features of the present invention will become more apparent upon a reading of the following summary and description of the invention and from the claims.

SUMMARY OF THE INVENTION

In one aspect, the present invention relates to golf balls exhibiting restricted flight characteristics. The balls have reduced coefficient of restitution values from about 0.560 to about 0.670, Riehle compression values from about 0.040 to about 0.070 inches, weigh approximately 45.0 to 46.0 grams and have diameters from about 1.67 to about 1.69 inches. The balls can be further restricted in flight through the use of an inefficient octahedral dimple pattern.

In another aspect, the invention is directed to restricted flight golf balls comprising of a core and a cover, wherein the core exhibits a coefficient of restitution from about 0.560 to about 0.640 and the cover adds an additional 0.020 to 0.030 points in coefficient of restitution to produce a finished ball having a coefficient of restitution of about 0.590 to about 0.670.

In a still further aspect, the invention relates to core compositions for one-piece or multi-layered restricted flight golf balls comprised of a sufficient amount of an elastomeric blend, at least one unsaturated carboxylic acid metal salt and a free radical initiator to produce a core compositions exhibiting a reduced coefficient of restitution from about 0.560 to about 0.670. Golf balls produced utilizing this core compositions can be further restricted in flight through the utilization of an inefficient octahedral dimple pattern.

DETAILED DESCRIPTION OF THE INVENTION

Figure 1:
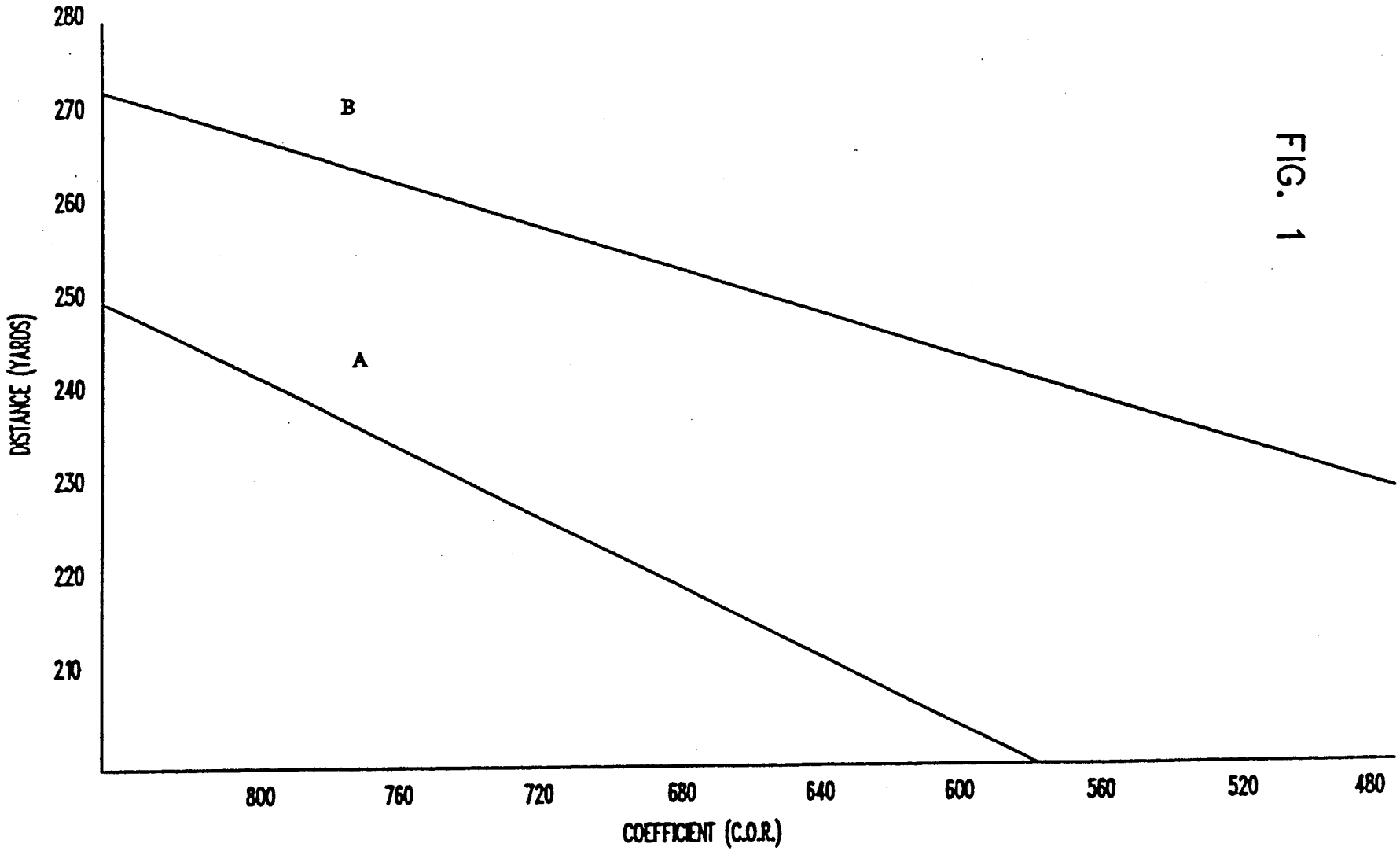
FIG. 1 is a graph which depicts the coefficient of restitution (C.O.R.) vs. carry and total distance (yards) of a standard range ball (Top-Flite® XL dimple pattern) at two different club head speeds (i.e. 160 ft./sec. ("A") and 145 ft./sec. ("B")). The 160 ft./sec. speed represents the average driver club head speed of a Touring Professional player, whereas 145 ft./sec. speed represents the average driver club head speed of a good player.

The present invention is directed to restricted or limited flight golf balls. Specifically, new elastomeric blends are provided for forming the cores of one piece or multi-layered balls having the desired reduced coefficient of restitution (C.O.R.) values necessary for restrictive flight performance (i.e. finished balls having C.O.R. values of about 0.560 to about 0.670, with C.O.R. values of about 0.560 to about 0.640 being preferred for the core compositions of multi-layered restricted flight golf balls). This is accomplished utilizing the elastomeric blends of the invention without sacrificing the compression (hardness), weight and feel of the resulting cured product.

The core compositions can be coated with standard cover stock compositions and/or additional layered compositions when utilized for the formation of multi-layered balls and/or configured with an inefficient dimple pattern to provide restricted flight golf balls having carrying distances about 45–50 yards shorter than that of standard range balls.

For example, the inventors have found in the most preferred embodiment of the invention discussed below in Example 1, that by combining the inefficient dimple design with multi-layered balls having low coefficient of restitution values (i.e. C.O.R. values of approximately 0.620, of which approximately 0.595 in C.O.R. is attributed to the core and approximately 0.025 in C.O.R.'s attributed to the cover) a reduction of 50.7 yards in total distance can be achieved when compared to Spalding Top-Flite® XL golf balls having a C.O.R. value of about 0.813 and a modified icosahedral dimple pattern, and a reduction of about 45 yards in comparison with Spalding Super Range ball having a C.O.R. of about 0.817 and an octahedral large dimple pattern.

As a result, the present invention is directed to the production of golf balls having reduced coefficient of restitution values (i.e. C.O.R. values of about 0.560 to about 0.670, with C.O.R. values of approximately 0.620 to 0.650 being the more preferred for multi-layered finished restricted flight golf balls) while maintaining the processing characteristics necessary for commercial application, as well as the overall performance properties (good impact resistance and durability) desired for driving range or reduced distance golf balls. The flight of the golf balls produced utilizing such low C.O.R. value compositions can be further restricted through the use of particular dimple patterns wherein the depth of the dimples and percentage of surface coverage are designed in such a manner to produce restricted flight.

Furthermore, the invention relates to the formulation of low coefficient of restitution elastomeric blends which, when utilized alone or with standard cover stock or additional layered compositions, produce golf balls having overall C.O.R. values of about 0.560 to about 0.670. Since in multi-layered balls it has been found that the resinous cover stock composition contributes approximately 0.020 to 0.030 points towards the balls overall coefficient of restitution (as well as increases the compression), the composition of the cores in multi-layered balls can be varied (i.e. cores exhibiting C.O.R. values of about 0.560 to about 0.640) in order to produce an overall ball exhibiting a coefficient of restitution of about 0.590 to about 0.670 with a coefficient of restitution of about 0.620 being preferred.

In this regard, it has been found that blends of diene rubber compositions may be formulated to produce one-piece balls and cores of multi-layered golf balls having the desired reduced C.O.R. values necessary for restrictive flight. The diene rubber or elastomeric blends used herein may be selected from those diene rubbers commonly utilized in golf ball construction. Examples of these materials include, but are not limited to, natural rubber, polyisoprene, polybutadiene, polychloroprene, butadienestyrene copolymers, butadiene-acrylonitrile copolymers, butadiene-acrylic acid copolymers, butadiene-methacrylic acid copolymers, butadiene-methyl acrylate copolymers, butadiene-methyl methacrylate copolymers, butadiene-vinyl pyridine-styrene copolymers, ethylene-propylenecylopentadiene copolymers, ethylene-propylene-5-ethylidene -2-norbornene copolymers, ethylene-propylene-1,4-hexadiene copolymers, isobutylene-isoprene copolymers, halogenated or highly unsaturated derivatives of isobutylene-isoprene copolymers, and norbornene ring-opened polymers, along and mixtures thereof.

However, of critical importance, these materials must be blended in such amounts, and under such conditions to produce commercially viable cured end products which exhibit coefficient of restitution values of about 0.560 to about 0.670 when utilized alone for one-piece golf ball construction, and coefficient of restitution values of about 0.560 to about 0.640, preferably about 0.595, when utilized as the core component for two-piece golf ball construction. Since, as indicated above, in the construction of a two-piece golf ball, the cover contributes approximately 0.020 to 0.030 additional points in C.O.R., the addition of the core component produces a restricted flight multi-layered golf ball having the desired overall C.O.R. values of about 0.590 to about 0.670.

Furthermore, as it is understood to those skilled in the art, the coefficient of restitution values of the elastomeric blends may also be further adjusted for the construction of three-piece or further multi-layered golf balls, wherein the additional layers may alter the balls' overall coefficient of restitution values. Thus, the materials may be blended and utilized under such conditions that the elastomeric blend produces, in combination with the other components of the ball, a coefficient of restitution of about 0.590 to about 0.670, with a C.O.R. value of 0.620 being preferred.

In particular, the inventors have found that blends of halobutyl rubber, such as bromobutyl rubber (containing up to 3% bromine) or chlorobutyl rubber (containing up to 3% chlorine), with high cis-polybutadiene (butadiene rubber) produce elastomeric compositions having the coefficient of restitution (C.O.R.) necessary for reducing the total driving distance of the ball. The halobutyl rubbers, such as the bromobutyl and the chlorobutyl rubbers are peroxide curable and compatible with polybutadiene.

In addition, it has also been found that elastomeric compositions containing polyisoprene and styrene-butadiene rubber (SBR) blends also provide desirable coefficient of restitution values. Such blends, however, are more difficult to process in certain equipment at large production levels because they can become quite sticky. As a result, this embodiment of the invention is less preferred to that set forth above.

The balls of the present invention, which are composed of blends of diene rubber compositions and preferably of blends of either polybutadiene/chlorobutyl rubber or bromobutyl rubber having a polybutadiene/-halobutyl rubber ratio of about 10:90 to about 90:10 or polyisoprene/styrene-butadiene blends having a polyisoprene/styrene-butadiene ratio of about 90:10 to about 10:90, are normal in compression and weight. More preferably, it has been found that blends of either polybutadiene/chlorobutyl or bromobutyl rubbers having a polybutadiene/halobutyl rubber ratio of about 70:30 to about 30:70 and most preferably having a polybutadiene/halobutyl rubber ratio of about 60:40 to about 40:60, and polyisoprene/styrene-butadiene blends having ratios of about 70:30 to about 30:70 and most preferably having a polyisoprene/styrene-butadiene ratio of about 50:50, produce the more preferred results, i.e. the production of balls exhibiting restricted flight performance without sacrificing the other desirable playability characteristics of the balls.

When these compositions are molded with an inefficient dimple pattern, the resulting balls are approximately 45–50 yards shorter than the longest range balls when hit with a driver at 160 ft./sec. The data indicates that approximately forty (40) percent of this distance loss is due to an inefficient dimple design and the remaining distance loss (i.e. sixty (60) percent) is due to a reduced coefficient of restitution.

When the balls of the present invention are comprised of a core and a cover, the core's diameter is 0.545:"±0.010", and the cover thickness is 0.0675"±0.010". With either the one-piece or the multi-layered ball, the overall ball diameter is 1.680"±0.010". In addition, the weight of the restricted flight golf ball of the present invention is well within the range of the standard weight golf balls, between about 44 and 46 grams. Moreover, the balls of the present invention exhibit approximately 100 PGA compression (i.e. Riehle compression values of about 0.040 to about 0.070 inches), have the same controllability characteristics of the standard high-quality golf balls, and have good feel and click properties when hit.

As indicated above, the core is essentially comprised of a combination of elastomeric compositions. In the preferred embodiment of the invention, the elastomers can be selected from among polybutadiene, polyisoprene, styrene-butadiene, and halobutyl rubbers such as bromo and chlorobutyl rubbers. Other elastomers may be utilized so long as the overall resulting C.O.R. values are about 0.560 to about 0.670, with about 0.560 to about 0.640 being the more preferred C.O.R. values for the core compositions of multi-layered restricted flight golf balls. In addition, and of critical importance, the elastomers must be blended in such a manner as to produce commercial viable end products exhibiting the playability characteristics desired by the average golfer.

For example, it has been found that when some blends of the above indicated diene rubber compositions were investigated, such as blends of nitrile rubbers (i.e. acrylonitrile-butadiene rubbers (NBR)), polyacrylate, etc., many processing difficulties resulted. Thus, the rubber blends of the present invention must exhibit not only the required coefficient of restitution values but must also the characteristics necessary for producing a commercially viable cured end product.

Of the various rubbers suitable for use in the invention, it has been found that polybutadiene (butadiene rubber), has the highest resilience or coefficient of restitution. However, when such butadiene rubbers are utilized alone for golf ball core construction, C.O.R. values of about 0.800 are produced. Such high C.O.R. values are unacceptable for the production of restricted or limited flight golf balls.

It has been found that polyisoprene (natural rubber) has lower C.O.R. values than polybutadiene when utilized for golf ball construction, and that styrene-butadiene rubber (SBR) has an even lower C.O.R. value than polyisoprene. Among the above group of applicable rubbers, the lowest C.O.R. is found in the bromo and chlorobutyl rubbers (copolymers of isobutylene and isoprene). However, these halobutyl rubbers exhibited C.O.R. values so low that the inventors were unable to accurately measure them. In addition, when the halobutyl rubbers were cured and dropped on the floor from 10 feet, the rebound off the floor was found to be only 1–2 inches.

However, notwithstanding the above, it was found that when the halobutyl rubbers are blended under certain conditions with the high molecular weight polybutadienes, that coefficient of restitutions of up to 0.800 are possible. As a result, the present invention is directed to the use of various blends of diene rubbers to produce golf balls exhibiting high enough C.O.R. values to produce the desirable playability characteristics of a golf ball (i.e. normal compression, weight and feel) while maintaining a C.O.R. value sufficiently low to reduce the carrying distance of the ball produced by the blended combination.

Various formulations comprising different combinations of the above-indicated applicable rubbers are possible. However, it has been found that due to processing difficulties, the halobutyl rubber/polybutadiene and the polyisoprene/styrene-butadiene rubber blends, along with suitable compatible modifying ingredients including, but not limited, to crosslinking agents, fillers, etc., are the best commercial embodiments of the present invention.

For example, in the most preferred embodiment of the invention set forth in Example 1 below, a ratio of about 43/57 halobutyl rubber/polybutadiene produced C.O.R. values of around 0.595, which, with a standard ionomer resin cover, produces a ball with C.O.R. values of around 0.620. This ball also exhibits the desired playability characteristics such as normal compression, weight and feel.

It has been further found that increasing the amount of polybutadiene will increase the C.O.R. of the balls and in turn increasing the amount of butyl rubber will decrease the C.O.R. of the balls. Thus, the C.O.R. values of the core composition can be adjusted by altering the amount of polybutadiene and halobutyl rubber in order to produce an overall ball having the desired C.O.R. value necessary for restrictive flight when utilized alone or in combination with cover compositions and/or inefficient dimple patterns.

As stated, it is the ratio of the bromo or chloro butyl rubber to the polybutadiene rubber that is controlling in the more preferred embodiment of the invention set forth in Example 1 below. Depending of the overall distance reduction of the ball desired, the ratio of the chloro or bromobutyl rubber to polybutadiene can range from 10/90 to 90/10 butyl rubber/polybutadiene. Similarly, in the less preferred embodiment of the invention (i.e. the non-butyl/polybutadiene mixtures), polyisoprene and styrene-butadiene rubber may be substituted for the elastomers set forth above.

According to the present invention, one-piece golf balls and/or cores of the multi-layered balls are prepared by molding the blended elastomeric or rubber compositions, an unsaturated carboxylic acid metal salt (a co-crosslinking agent), and a free radical initiator (a co-crosslinking agent). In addition, suitable and compatible modifying ingredients including, but not limited to, metal oxide activators, fatty acids, fillers and other additives may be added in addition to the critical elastomeric compositions.

The polybutadienes (butadiene rubbers) suitable for use as one of the components of the blended elastomeric compositions include any halobutyl rubber compatible cis-polybutadiene. As it is understood by those skilled in the art, the cis content of the polybutadiene is not critical. However, low cis-polybutadiene/butyl rubber blends will require greater amounts of polybutadiene while high cis-polybutadiene/butyl rubber blends will require greater amounts of butyl rubber to obtain the C.O.R. values desired.

Along this line, it has been found that the high cis-polybutadiene manufactured and sold by Shell Chemical Co., Houston, Texas, under the tradename Cariflex BR-1220 is particularly well suited. Examples of other suitable cis-polybutadienes include JSR BR-01 manufactured and sold by Japan Synthetic Rubber, Taktene 1220 produced by Bayer U.S.A., Buna CB-30 manufactured and sold by Bayer Germany, Nipol BR-1220 produced by Nippon Zeon Co. Japan, and Diene 35 manufactured by Firestone Synthetic Rubber U.S.A.

As the halobutyl rubber component of the blended rubber composition, it has been found that chlorobutyl rubber or bromobutyl rubber (containing up to 3% chlorine or bromine) produce the characteristics desired. For example, the bromobutyl rubber composition manufactured and sold by Exxon Chemical, Houston, Texas under the designation Exxon 2255 is well suited for the present invention. Exxon 2255 exhibits the following general characteristics: Mooney viscosity of 46; specific gravity of 0.93; bromine content of 2%; and water content of 0.3% maximum. Furthermore, it has been found that chlorobutyl rubber composition produced by Exxon under the designation 1066 can be utilized to produce elastomeric compositions exhibiting the characteristics of the present invention.

The polyisoprene utilized in the elastomeric blend may be any polyisoprene having the following general properties: cis content of 90% minimum; Mooney viscosity of 50–85; specific gravity of 0.91–0.92; and, antioxidant of 0.8–1.0 weight percent. The polyisoprene sold by Muehlstein H. & Co., Greenwich, CT., under the designation SKI-35 is well suited for use in the invention.

As the styrene-butadiene rubber (SBR) component of the elastomeric blend, styrene-butadiene rubbers having the following properties may be utilized in the invention: Mooney viscosity of 25–80; styrene content of 20%–60%; and specific gravity of 0.90–0.95. The commercially available styrene-butadiene rubber sold by Polysar, Inc., Akron, Ohio, under the designation S-1018 is suitable for use in the elastomeric blend of the invention.

Examples of the co-crosslinking agent include unsaturated carboxylic acids and metal salts thereof, acrylic acid, methacrylic acid, maleic acid, fumaric acid, and metal salts thereof, e.g., Zn, Na, K, Ca, and Al salts, with zinc diacrylate being most preferred. The unsaturated carboxylic acid metal salt co-crosslinking agent may be blended in amounts of about 15 to about 45 parts by weight per 100 parts by weight of the rubber (phr) component. The unsaturated carboxylic acids and metal salts thereof are generally soluble in the rubber or elastomeric base, or are readily dispersible.

The elastomer is cross-linked by the free radical initiator. The term free radical initiation as used herein refers to a chemical which, when added to a mixture of the elastomeric blend and a metal salt of an unsaturated carboxylic acid, promotes crosslinking of the elastomers by the metal salt of the unsaturated carboxylic acid. The free radical initiator included in the core composition is any known polymerization initiator which starts the polymerization process and which decomposes during the cure cycle. The amount of the selected initiator present is dictated only by the requirements of catalytic activity as a polymerization initiator. Examples of the free radical initiator include organic peroxides, such as dicumyl peroxide, 1,1-bis(tert-butylperoxy) -3,3,5-trimethylcyclohexane, n-butyl-4,4-bis(t-butylperoxy) -valerate, 2,2'-bis(t-butylperoxy-isopropyl)benzene, and 2,5-dimethyl-2,5-di-(t-butylperoxy)hexene, and mixtures thereof. It may be blended in amounts of about 0.2 to about 10.0 parts by weight per 100 parts by weight of the rubber (phr) component. It will be understood that the total amount of initiators used will vary depending on the specific end product desired and the particular initiators employed.

Examples of such commercial available peroxides are Luperco 231 XL, a peroxyketal manufactured and sold by Atochem, Lucidol Division, Buffalo, N.Y., and Trigonox 29/40, a1,1-di-(t-butylperoxy)-3,3,5-trimethylcyclohexane sold by Akzo Chemie America, Chicago, IL. The one hour half life of Luperco 231 XL is about 112° C., and the one hour half life of Trigonox 29/40 is about 129° C.

Moreover, if desired, the rubber compositions can also contain additional additives (i.e. diisocyanates, metal oxides, fatty acids, fillers, etc.) which are generally employed in the preparation of rubber composition for one-piece or multi-layered balls. For example, Papi 94, a polymeric diisocyanate, commonly available from Dow Chemical Co., Midland, MI., is an optional component in the rubber compositions. It can range from about 0 to about 5 parts by weight per 100 parts by weight rubber (phr) component, and acts as a moisture scavenger.

Various activators may also be included in the compositions of the present invention. For example, zinc oxide and/or magnesium oxide are activators for the polybutadiene and a curative for bromobutyl. The activator can range from about 2 to about 30 parts by weight per 100 parts by weight of the rubbers (phr) component.

In addition, low molecular weight fatty acids, such as stearic acid and linoleic acid act as activators and as internal lubricants, thereby functioning to improve moldability and processing. When employed the selected fatty acid, or mixtures thereof, can range from about 1 to about 6 parts by weight per 100 parts by weight of the rubber (phr) component.

Fillers such as ground flash, mineral fillers and selected resins are optional constituents in the overall rubber compositions. Any known and conventional filler, or mixtures thereof, may be used. Such fillers should be in finely divided form, as for example, in size generally less-than about 20 mesh and preferably less than about 325 mesh U.S. standard size. The fillers are typically relatively inexpensive and heavy and serve to lower the cost of the ball and to increase the weight of the ball to closely approach the U.S.G.A. weight limit of 1.620 ounces. They can also increase the hardness of the ball and either lower or have no effect on the C.O.R..

Ground flash filler is preferably 20 mesh ground up center stock from the excess flash from compression molding. It lowers the cost and increases the hardness of the ball. Ground flash is neutral in its affect on C.O.R., and can be present in the composition from about 0 to about 40 parts by weight per 100 parts by weight of the rubber (phr) component.

Mineral fillers can include limestone, silica, mica barytes, calcium carbonate, or clays. Limestone is ground calcium/magnesium carbonate and is typically used because it is an inexpensive, heavy filler. It also lowers the C.O.R. depending on how much is added, with an upper limit being the desired ball weight. The amount of limestone or other mineral filler added to the composition can range from about 0 to about 50 parts by weight per 100 parts by weight of the rubber (phr) component, depending on the desired resulting weight of the ball.

Powdered polypropylene resin can also be included as a filler. It can range between about 0 to about 50 parts by weight per 100 parts by weight of the rubber (phr) component. Polypropylene resin functions to increase the hardness of the ball and to lower the C.O.R.. An added benefit of using the polypropylene resin is the fact that it serves to lower the cost of the completed golf ball.

The golf balls of the invention are prepared by mixing the components of the rubber compositions by means well known in the art. For example, the rubber compositions, metal salts of carboxylic acids, fillers, fatty acids are mixed according to a batch process in a mixer such as a Banbury internal mixer, for about six minutes. The mixing is desirably conducted in such a manner that the composition does not reach incipient polymerization temperature during the blending of the various components. Free radical initiator catalysts, such as peroxides, and the diisocyanate are admixed with the core composition so that the heat and pressure during mixing does not initiate a premature cross-linking reaction in the Banbury mixer. Mixing is continued until the temperature reaches about 220° F. whereupon the batch is discharged onto a two roll mill, mixed for about one minute and sheeted out. The sheet is rolled into a "pig" and then placed in a Barwell performer and slugs are produced.

The composition can then be formed into a solid or core structure by any one of a variety of molding techniques, e.g., injection, compression, or transfer molding well known in the art. For example, the slugs can be subjected to compression molding at about 320° F. for about 14 minutes with cooling effected by about 8 minutes at a mold temperature of about 100° F., followed by about 4 hours at room temperature. As it is understood by those skilled in the art, the temperature, time, and pressure for the molding and curing process can be adjusted dependent upon the overall composition of the desired ball.

The above-formulated rubber composition may then be molded into the desired spherical size and shape. If a two piece or multi-layered ball is desired the molded core may by placed in the center of a golf ball mold having the inefficient dimple pattern discussed below and the cover composition injected hot into and retained in the space for a cooling period of time at a temperature from about 40° F. to about 120° F.

Alternatively, the cover composition may be injection molded at about 300° F. to about 450° F. into smooth-surfaced hemispherical shells. Two such shells are then placed around the core in a dimpled golf ball mold having the inefficient dimple pattern discussed below and subject to compression molding at temperatures on the order of from about 200° F. to about 300° F.

for 2–10 minutes to fuse the shells together to form a unitary ball.

When the core composition is utilized for the construction of multi-layered balls, the cover used on the balls is any material commonly used in the golf ball industry including balata, polyurethane, and ionomer resins. Various ionomers of the type known to those skilled in the art or blends thereof, and various resilient compositions such as those disclosed in U.S. Pat. Nos. 3,359,231, 4,398,000, 4,234,184, 4,295,652, 4,248,432, 3,989,516, 3,310,102, 4,337,947, 4,123,061, 3,490,146 and 4,986,545 may be utilized. The cover composition preferably is made from ethylene-acrylic acid or ethylenemethacrylic acid copolymers which are partially neutralized with mono or polyvalent metals such as sodium, potassium, lithium, calcium, zinc, or magnesium. While the scope of the patent embraces all known ionomeric resins suitable for use in the present invention, only a relatively limited number of these ionomeric resins are commercially available.

In this regard, the ionomeric resins sold by E. I. DuPont de Nemours Company under the trademark "Surlyn ®", and the ionomer resins sold by Exxon Corporation under either the trademark "Escor ®" or the tradename "Iotek" are examples of commercially available ionomeric resins which may be utilized in the present invention. The ionomeric resins sold formerly under the designation "Escor ®" and now under the new name "Iotek", are very similar to those sold under the "Surlyn ®" trademark in that the "Iotek" ionomeric resins are available as sodium of zinc salts of poly(ethylene acrylic acid) and the "Surlyn" resins are available as zinc or sodium salts of poly(ethylene methacrylic acid). In addition, various blends of "Iotek" and "Surlyn" ionomeric resins, as well as other available ionomeric resins, may be utilized in the present invention.

In addition, if it is desired to further reduce the coefficient of restitution of the ball, it is understood that a cover composition exhibiting lower C.O.R. values while maintaining the desirable playability characteristics can be utilized.

In the embodiments of the invention that are set forth below, the cover included acrylic acid ionomer resin having the following compositions:

| | % weight |
|---|---|
| Iotek 4000[1] | 52.4 |
| Iotek 8000[2] | 45.3 |
| Unitane 0-110[3] | 2.25 |
| Ultramarine blue[4] | 0.0133 |
| Santonox R[5] | 0.0033 |

[1]Iotek 4000 is a zinc salt of poly (ethylene acrylic acid)
[2]Iotek 8000 is a sodium salt of poly (ethylene acrylic acid)
[3]Unitane 0-100 is a titanium dioxide sold by Kemira Inc., Savannah, GA.
[4]Ultramarine Blue is a dye sold by Whitaker, Clark, and Daniels of South Painsfield, N.J.
[5]Santonox R is a antioxidant sold by Monsanto, St. Louis, MO.

It is to be noted that the cover stock provides about 20 to 30 points (i.e. 0.020–0.030 C.O.R.) toward the ball's overall coefficient of restitution. By varying the composition of the core, and taking into account the C.O.R. of the cover, the coefficient of restitution of the overall ball can be varied to fall within the desired ranges.

In order to reduce the driving distance by 50 yards, it has been found that an overall coefficient of restitution value of the finished ball of about 0.590 to about 0.670, with a C.O.R. value of around 0.620 being the more preferred) combined with an inefficient dimple pattern such as that described below will achieve the desired result. However, as indicated in FIG. 1, the C.O.R. values of the core composition can be altered in order to increase or decrease the desired reduction in carrying distance.

After molding, the golf ball is then painted and marked, painting being effected by spraying techniques.

In addition to the above, applicants have discovered that the flight of golf balls produced utilizing the reduced C.O.R. value compositions of the invention can be further restricted by configuring such balls with an inefficient octahedral dimple pattern. Such restricted flight golf balls have an octahedral dimple pattern with four substantially equilateral triangles on each of the hemispheres and with a dimple-free equator separating the two hemispheres. Each hemisphere has a dimple pattern substantially the same as the other hemisphere, with less than 50% of the surface being covered with the dimples and the dimples having a depth between 0.0110 and 0.0120 inch and a diameter between 0.123 and 0.129 inch. In a preferred golf ball there are 336 dimples on the surface of the golf ball with each dimple having a diameter of substantially 0.128 inch and a depth of substantially 0.0115 inch.

Referring to FIGS. 2–5, it has been found that a golf ball having a basic octahedral dimple pattern on the surface thereof with a dimple-free equatorial line separating the ball into two hemispheres, each hemisphere having a pole P, exhibits restricted flight.

In this regard, each hemisphere is equally divided by four substantially equilateral triangles. Since each hemisphere has an identical dimple pattern, only one such pattern will be described.

Ball 11 has four equally spaced dimples 13, 15, 17, and 19 surrounding and spaced from the pole P. Lines 23 and 25 extend toward the equator from dimple 13 with these lines being substantially 90° apart. Lines 27 and 29 extend in a like manner from dimple 15, lines 31 and 33 extend in a like manner from dimple 17, and lines 35 and 37 extend in a like manner from dimple 19. Each of the equilateral triangles are substantially the same and contain the same dimple configuration.

Figure 2:
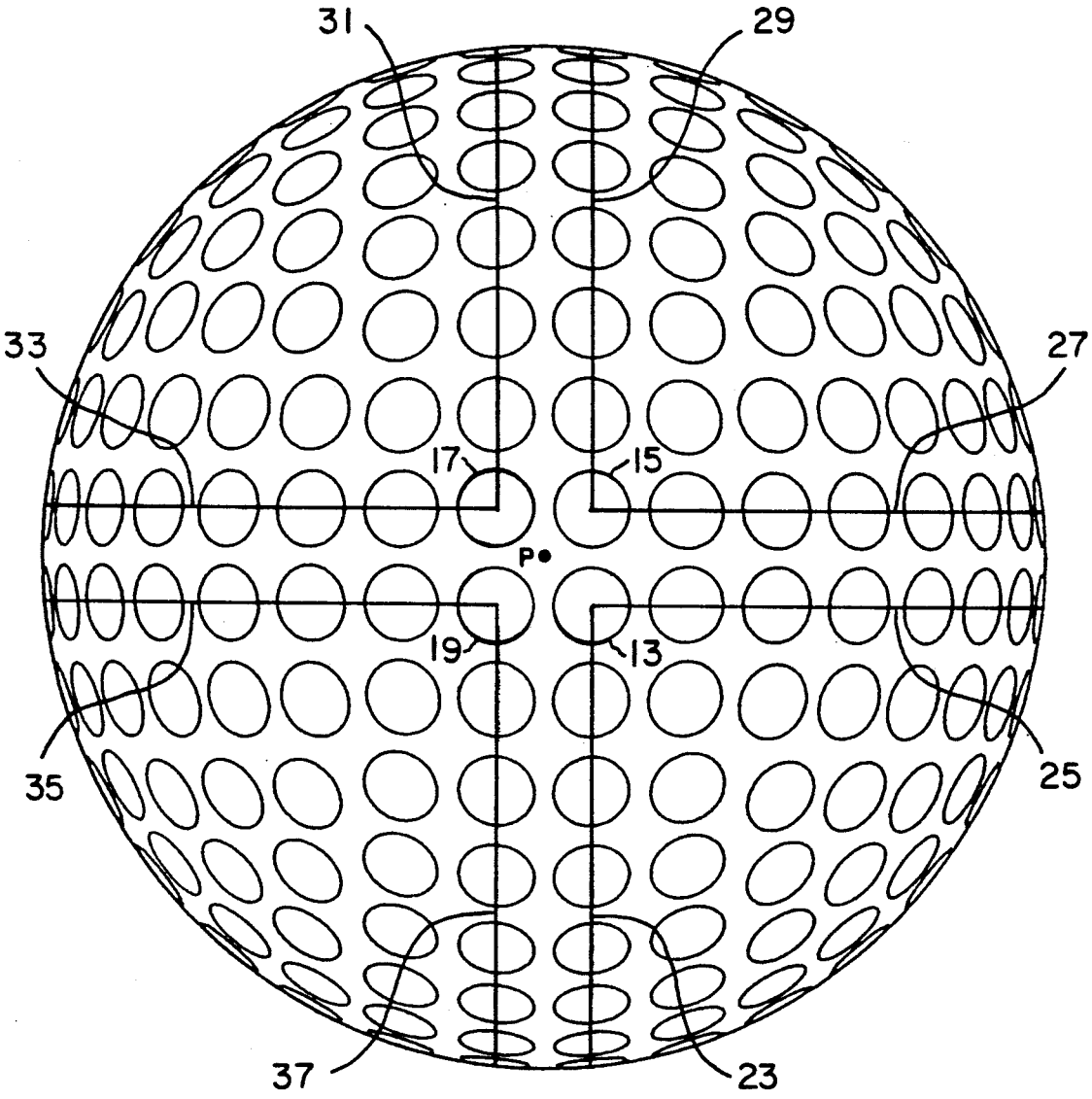
FIG. 2 is a pole view of the preferred inefficient dimple pattern utilized in the present invention.
Figure 3:
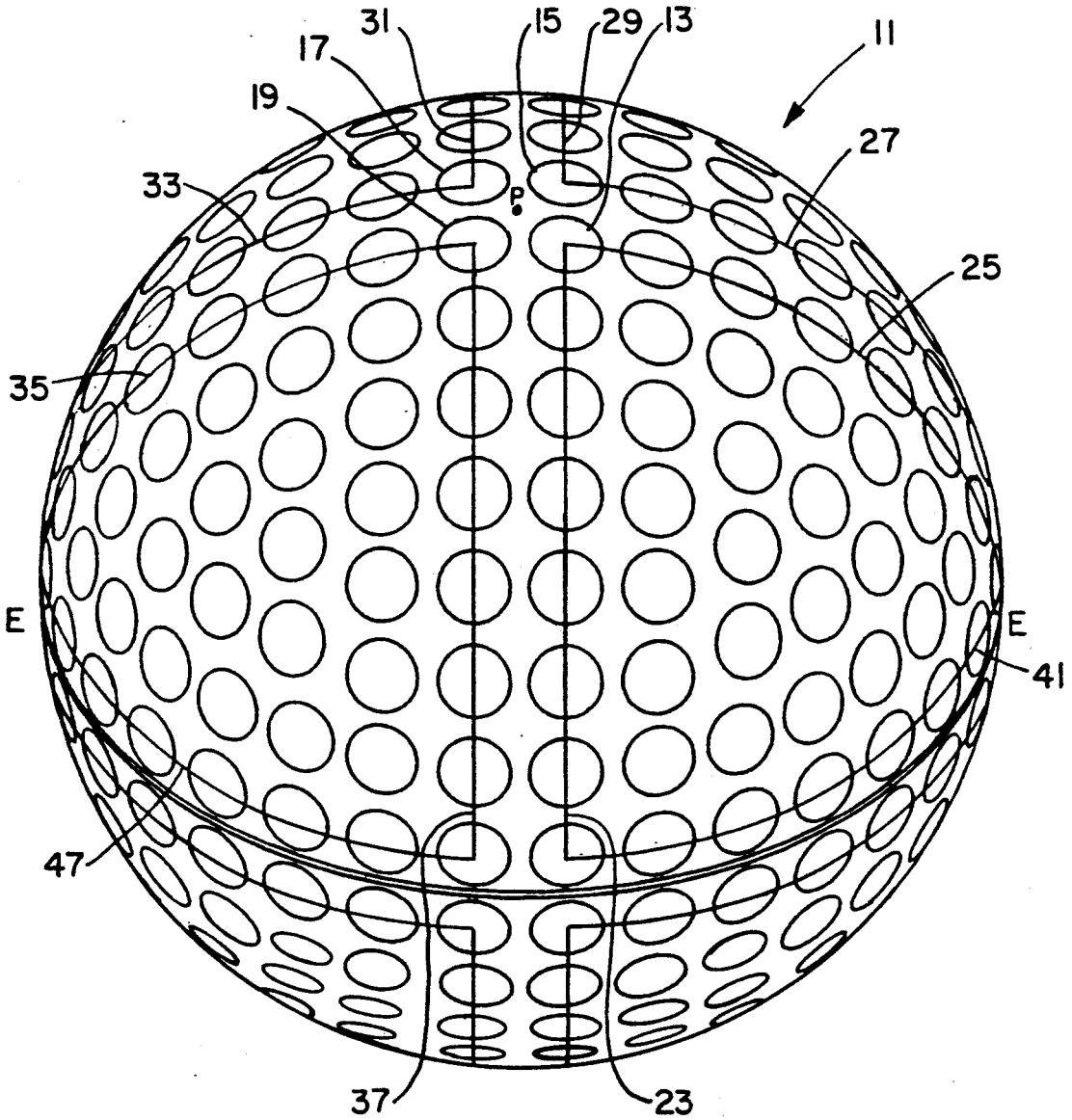
FIG. 3 is an off equator view of the dimple pattern of FIG. 2.
Figure 4:
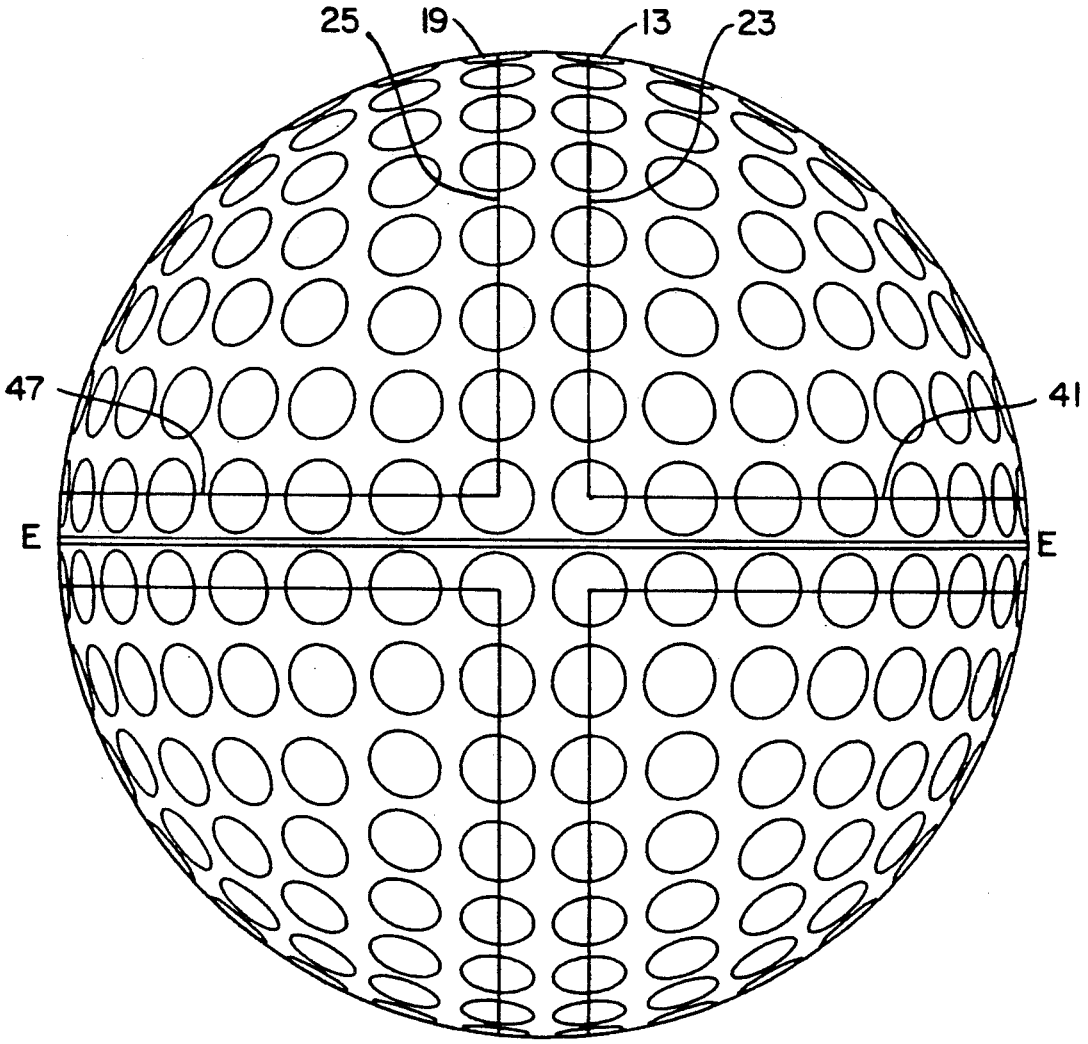
FIG. 4 is a an equator view of the dimple pattern of FIG. 2.

Referring specifically to FIGS. 2 and 3, there is shown sides 41 and 47 of two of the triangles. These sides extend one-fourth the distance about the ball and are substantially parallel with the dimple-free equator E—E. The remaining sides of each triangle extend between the equatorial dimples and the pole and have the plurality of in-line dimples. The remaining spaces between the sides of the triangles are also filled with dimples.

In order to restrict the flight of the ball, the total area of the surface of the ball covered by dimples has been reduced to less than 50%. Additionally, by making the dimples quite shallow, the dimple diameter/depth ratio raises the trajectory of the ball of the otherwise low trajectory due to the very low coefficient of the ball, thus, further restricting flight distance.

Figure 5:
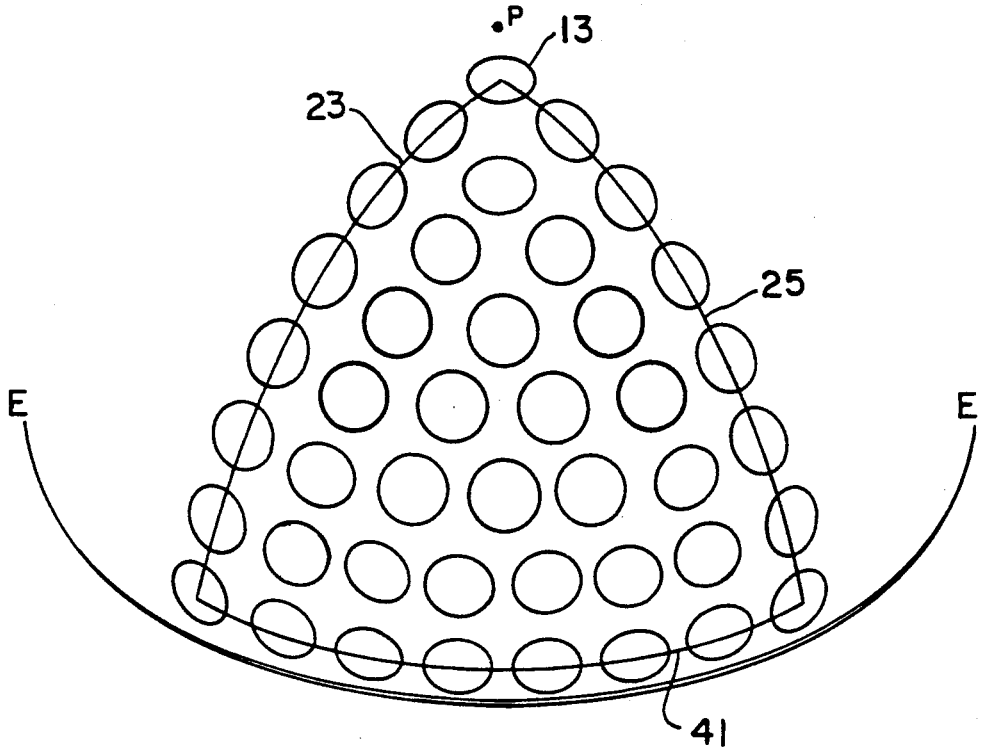
FIG. 5 is a diagrammatic showing of one of the equilateral triangles forming the pattern of the ball of FIG. 2.
Figure 6:
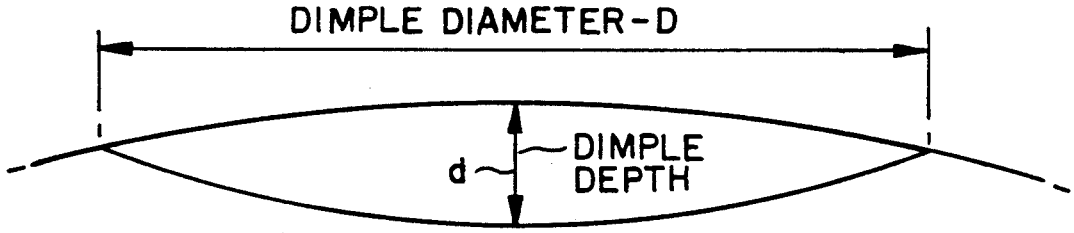
FIG. 6 is a schematic showing of the method of measuring the diameter and depth of the dimple.

FIG. 5 illustrates one of the eight triangles used in the preferred ball of the inventor. In addition, FIG. 6 is an illustration of the measurement of the diameter D and the depth d of the dimples on the ball.

The inefficient dimple pattern is produced by providing molds which have the complementary surface configurations.

The present invention is further illustrated by the following examples in which the parts of the specific ingredients are by weight (phr). It is to be understood that the present invention is not limited to the examples, and various changes and modifications may be made in the invention without departing from the spirit and scope thereof.

EXAMPLE 1

The following materials were mixed together for six minutes in a Banbury mixer at a maximum temperature of 220° F. in the relative amounts according to Table I in order to produce the preferred embodiment of the present invention:

TABLE I

| MATERIAL | WEIGHT | VOLUME | 100% | PPH |
|---|---|---|---|---|
| bromobutyl rubber (2255)[1] | 43.0 | 46.24 | 18.77 | 100 |
| polybutadiene (BR-1220)[2] | 57.0 | 62.64 | 24.88 | 133 |
| zinc diacrylate | 18.0 | 6.92 | 7.86 | 42 |
| ground flash | 20.0 | 16.67 | 8.73 | 47 |
| zinc oxide | 3.0 | .54 | 1.31 | 7 |
| stearic acid | 2.0 | 2.38 | 0.87 | 4.7 |
| limestone | 44.0 | 17.60 | 19.21 | 103 |
| polypropylene (6400P)[3] | 40.0 | 44.44 | 17.46 | 93 |
| yellow M.B.[4] | 0.1 | 0.01 | 0.04 | 0.233 |
| peroxide (29/40)[5] | 1.5 | 1.06 | 0.65 | 3.50 |
| polymeric diisocyanate(Papi 94)[6] | 0.5 | 0.39 | 0.22 | 1.16 |
| TOTAL | 229.1 | 198.89 | | 534.59 |
| Sp.GR. | | | | 1.152 |

[1]2255 is a bromobutyl rubber manufactured and sold by Exxon Chemicals Americans, Houston, TX.
[2]BR-1220 is a polybutadiene manufactured and sold by Shell Chemical Co., Houston, TX.
[3]6400P is a powdered polypropylene available from Amoco Chemical Co., Chicago, IL.
[4]Yellow M.B. is added for identification purposes only.
[5]29/40 is Trigonox 29/40 manufactured and sold by Akzo Chemie America, Chicago, IL.
[6]Papi 94 is a polymeric diisocyanate available from Dow Chemical Co., Midland, MI.

After Barwell extrusion to produce slugs, the slugs were compression molded for about 11 minutes at 320° F. to produce centers having approximately the following desirable properties (average):

| | |
|---|---|
| Size | 1.547 inches |
| Weight | 36.6 grams |
| Riehle Compression | .059 inches |
| C.O.R. | .595 |

An ionomer resin cover composition was then applied over the centers in an inefficient dimple pattern configuration in order to formulate the restrictive flight golf balls by the processes set forth above. The finished balls exhibited the following general properties:

| | |
|---|---|
| AVERAGE DIAMETER: | 1.683 inches |
| AVERAGE WEIGHT: | 45.3 grams |
| AVERAGE COMPRESSION (RIEHLE):[1] | .053 |
| AVERAGE C.O.R.[2] | .620 |
| C.O.R. RANGE[2] | .605–.629 |

[1]Riehle compression is a measurement of the deformation of a golf ball in inches under a fixed static load of 200 lbs.
[2]Coefficient of restitution (e) was measured by firing the resulting golf ball in an air cannon at a velocity of approximately 125 feet per second against a steel plate which is positioned 12 feet from the muzzle of the cannon. The rebound velocity was then measured. The rebound velocity was divided by forward velocity to give coefficient of restitution.

The balls were then subjected to standard distance tests in order to compare the reduction in carrying flight distance in relation to Spalding's Top-Flite ® XL ball, Spalding's Super Range ball and two "limited flight" competitor balls. The results are set forth below:

A. DISTANCE REPORT 1
Club Name: 9 DEG METAL WOOD Club Head Speed: 160 ft./sec

| Conditions: | Before Test: | After Test: |
|---|---|---|
| Launch Angle - degrees | 9.2 | N/A |
| Ball Speed - fps | 231 | N/A |
| Spin Rate - rpm | 3136 | N/A |
| Turf Condition | FIRM & DAMP | FIRM & DAMP |
| Wind - mph/dir. | 5/315 | 6/55 |
| Temp/RH - deg °F. % | 59.9/92.9 | 61.9/75.9 |

| Ball Type | Traj | Flight Time (Secs) | Carry Dist (Yards) | Carry Diff | Ctr Dev | Roll | Total Dist | Total Diff |
|---|---|---|---|---|---|---|---|---|
| A | 14.1 | 6.4 | 255.7 | 0.0 | 4.83 | 32.2 | 287.9 | 0.0 |
| B | 14.3 | 6.5 | 250.3 | −5.4 | 5.33 | 32.6 | 282.9 | −5.0 |
| C | 15.9 | 5.4 | 203.8 | −51.9 | 2.50 | 33.0 | 237.2 | −50.7 |
| D | 13.0 | 5.5 | 214.2 | −41.4 | 5.83 | 35.5 | 250.8 | −37.1 |
| E | 12.1 | 5.9 | 232.3 | −23.4 | 1.58 | 35.6 | 268.2 | −19.7 |

BALL TYPE CHARACTERISTICS

| BALL TYPE | SIZE (inches) | WEIGHT (grams) | COMPRESSION (RIEHLE) | C.O.R. |
|---|---|---|---|---|
| A | 1.680 | 45.1 | .055 | .813 |
| B | 1.681 | 45.2 | .055 | .817 |
| C | 1.683 | 45.3 | .053 | .620 |
| D | 1.681 | 46.0 | .095 | .684 |
| E | 1.686 | 45.6 | .052 | .707 |

KEY TO BALL TYPES
A = TOP-FLITE ® XL CONTROL
B = SPALDING SUPER RANGE
C = SPALDING RESTRICTED FLIGHT RANGE BALL
D = COMPETITIVE "LIMITED FLIGHT" 1 PIECE RANGE BALL
E = COMPETITIVE "LIMITED FLIGHT" 2 PIECE RANGE BALL

B. DISTANCE REPORT 2
Club Name: 9 DEG METAL WOOD Club Head Speed: 145 ft./sec.

| Conditions: | Before Test: | After Test: |
|---|---|---|
| Launch Angle - degrees | 9.0 | N/A |
| Ball Speed - fps | 211 | N/A |
| Spin Rate - rpm | 2783 | N/A |
| Turf Condition | DAMP | WET |
| Wind - mph/dir. | 3/334 | 2/239 |
| Temp/RH - deg °F. % | 52.8/89.1 | 54/86.3 |

| Ball Type | Traj | Flight Time (Secs) | Carry Dist (Yards) | Carry Diff | Ctr Dev | Roll | Total Dist | Total Diff |
|---|---|---|---|---|---|---|---|---|
| A | 12.4 | 5.6 | 224.3 | 0.0 | −7.42 | 33.7 | 257.9 | 0.0 |
| B | 12.7 | 5.6 | 221.2 | −3.0 | −5.83 | 30.5 | 251.7 | −6.2 |
| C | 14.4 | 4.8 | 177.3 | −46.9 | −5.67 | 31.4 | 208.7 | −49.2 |
| D | 11.8 | 5.0 | 188.7 | −35.5 | −3.42 | 33.8 | 222.5 | −35.4 |
| E | 10.4 | 5.2 | 203.9 | −20.4 | −7.25 | 36.5 | 240.4 | −17.5 |

C. DISTANCE REPORT 3
Club Name: 5 IRON Club Head Speed: 125 ft./sec.

| Conditions: | Before Test: | After Test: |
|---|---|---|
| Launch Angle - degrees | N/A | N/A |
| Ball Speed - fps | N/A | N/A |
| Spin Rate - rpm | N/A | N/A |
| Turf Condition | WET | WET |
| Wind - mph/dir. | 4/91 | 6/76 |
| Temp/RH - deg °F. % | 54.8/96.8 | 55.4/89.9 |

| Ball Type | Traj | Flight Time (Secs) | Carry Dist (Yards) | Carry Diff | Ctr Dev | Roll | Total Dist | Total Diff |
|---|---|---|---|---|---|---|---|---|
| A | 25.2 | 6.0 | 176.3 | −0.0 | 4.00 | 13.2 | 189.5 | 0.0 |
| B | 25.0 | 5.5 | 176.4 | 0.0 | 5.25 | 10.8 | 187.2 | −2.3 |
| C | 20.2 | 4.8 | 143.0 | −33.3 | 3.75 | 20.5 | 163.5 | −26.0 |
| D | 21.0 | 5.3 | 162.3 | −14.0 | 3.42 | 20.5 | 182.9 | −6.6 |
| E | 22.1 | 5.4 | 165.4 | −11.0 | 3.00 | 20.7 | 186.0 | −3.5 |

The driving machine test data of the restricted flight range balls of the present invention (i.e. ball "C" above) clearly indicates that the balls of the invention exhibit enhanced distance reduction when compared to the prior art (i.e. enhanced distance reduction of 13.6 and 31 yards respectfully over the prior art in Distance Report 1, and 13.8 and 31.8 yards respectively in Distance Report 2).

In addition, by combining the inefficient dimple design with the low C.O.R. values of this ball (C.O.R. values of 0.620) a total reduction of 50.7 yards (see Distance Report 1) was achieved when compared with a Top-Flite ® XL control ball having a C.O.R. value of 0.813 and a modified icosahedral dimple pattern. Furthermore, as exhibited by similar compression, weight and size characteristics of the restricted flight balls in comparison to conventional golf balls, the restricted flight balls maintain the playability characteristics of a normal ball.

EXAMPLE 2

Golf ball centers having the following composition were formed:

| | pph |
|---|---|
| polyisoprene (SKI-35)[1] | 50.00 |
| styrene butadiene rubber (S-1018)[2] | 50.00 |
| zinc oxide | 6.00 |
| zinc diacrylate | 27.00 |
| zinc stearate | 15.00 |
| regrind | 20.00 |

-continued

| | pph |
|---|---|
| polypropylene (6400P)[3] | 50.00 |
| limestone | 48.00 |
| peroxide (231 XL)[4] | 2.00 |
| polymeric diisocyanate (Papi 94)[5] | 0.50 |

[1]The polyisoprene was SKI-35, a russian polyisoprene available from Muehlstein, H. & Co., Greenwich, CT.
[2]The styrene-butadiene rubber (SBR) used is S-1018 available from Polysar, Inc., Akron, OH.
[3]The powdered polypropylene, 6400P, is available from Amoco Chemical Co., Chicago, IL.
[4]231 XL is Luperco 231 XL manufactured and sold by Atochem, Lucidol Division, Buffalo, N.Y.
[5]Papi 94 is a polymeric diisocyanate available from Dow Chemical Co., Midland, MI.

The resulting center (core) properties (average) were as follows:

Size 1.539 inches
Weight 37.2 grams
Compression 0.055 inches
C.O.R. 0.627

Once the standard acrylic acid ionomic resin cover was applied, the finished ball had the following properties (average):

Size 1.678 inches
Weight 45.9 grams
Compression 0.038
C.O.R. 0.648

The balls were then subject to standarized distance tests in order to compare the reduction in carrying flight of this embodiment of the invention. The results of the distance tests are set forth below:

A. DISTANCE REPORT 4
Club Name: 9 DEG METAL DRIVER Club Head Speed: 160 ft./sec.

| Conditions: | Before Test: | After Test: |
|---|---|---|
| Launch Angle | 8.9 degrees | 7.8 degrees |
| Ball Speed | 237 fps | 232 fps |
| Spin Rate | 2505 rpm | 2745 rpm |
| Wind | 1.0 mph @ 305° | 4.0 mph @ 297° |
| Temp/RH | 63° F. 32% | 69° F. 27% |
| Turf | Firm & Dry | Firm & Dry |

| Ball Type | Traj | Flight Time (Secs) | Carry Dist (Yards) | Carry Diff | Ctr Dev | Roll | Total Dist | Total Diff |
|---|---|---|---|---|---|---|---|---|
| A | 13.8 | 5.7 | 226.0 | −26.9 | −.29 | 15.9 | 241.9 | −32.5 |
| B | 17.0 | 5.5 | 208.6 | −44.3 | −.21 | 13.4 | 221.2 | −53.3 |
| C | 13.8 | 5.4 | 221.5 | −41.5 | −1.42 | 18.4 | 229.1 | −45.3 |
| D | 11.6 | 6.1 | 246.6 | −6.3 | −1.88 | 21.4 | 268.1 | −6.4 |
| E | 10.8 | 5.9 | 240.0 | −13.0 | .96 | 22.2 | 262.2 | −12.3 |
| F | 11.8 | 6.3 | 253.0 | 0.0 | −1.25 | 21.5 | 274.4 | 0.0 |

BALL TYPE CHARACTERISTICS

| BALL TYPE | SIZE (inches) | WEIGHT (grams) | COMPRESSION (RIEHLE) | C.O.R. |
|---|---|---|---|---|
| A | 1.680 | 45.5 | .053 | .754 |
| B | 1.679 | 41.2 | .043 | .672 |
| C | 1.678 | 45.9 | .038 | .648 |
| D | 1.681 | 45.0 | .057 | .808 |
| E | 1.682 | 45.5 | .055 | .757 |
| F | 1.682 | 45.5 | .057 | .806 |

KEY TO BALL TYPES
A = LOW COST CENTER, INEFFICIENT DIMPLE PATTERN
B = LOW COEFFICENT CENTER, LIGHT WEIGHT, INEFFICEINT DIMPLE PATTERN
C = LOW COEFFICENT CENTER, REGULAR WEIGHT, INEFFICIENT DIMPLE PATTERN
D = SUPER RANGE TOP GRADE CENTER, OCTAHEDRAL, LARGE DIMPLE PATTERN
E = SUPER RANGE LOW COST CENTER, OCTAHEDRAL, SMALL DIMPLE PATTERN
F = TOP-FLITE ® XL II (CONTROL) MODIFIED ICOSAHEDRAL DIMPLE PATTERN

B. DISTANCE REPORT 5
Test Date: 12/06/90
Club Name: 5 IRON Club Head Speed: 125 ft./sec.

| Conditions: | Before Test: | After Test: |
|---|---|---|
| Launch Angle | N/A degrees | N/A degrees |
| Ball Speed | N/A fps | N/A fps |
| Spin Rate | N/A rpm | N/A rpm |
| Turf | FIRM & DAMP | FIRM & DRY |
| Wind | 0.0 | 0.0 |
| Temp/RH | 62° F. 46% | 62° F. 46% |

| Ball Type | Traj | Flight Time (Secs) | Carry Dist (Yards) | Carry Diff | Ctr Dev | Roll | Total Dist | Total Diff |
|---|---|---|---|---|---|---|---|---|
| A | 26.6 | 5.5 | 157.5 | −9.0 | −1.83 | 12.4 | 169.9 | −7.5 |
| B | 25.7 | 5.4 | 145.7 | −20.8 | −1.75 | 11.5 | 157.2 | −20.2 |
| C | 23.0 | 5.1 | 146.0 | −20.6 | −1.25 | 15.2 | 161.2 | −16.3 |
| D | 27.6 | 5.9 | 166.5 | 0.0 | −2.58 | 10.9 | 177.4 | 0.0 |
| E | 25.3 | 5.6 | 160.3 | −6.3 | −1.83 | 12.0 | 172.3 | −5.1 |
| F | 28.2 | 5.9 | 164.8 | −1.7 | −3.08 | 10.7 | 175.5 | −1.9 |

The results show that the ball of the present invention (i.e. ball "C") exhibits a greater reduction in total distance than all of the tested balls with the exception of the low coefficient, light weight ball (i.e. ball "B"). However, as indicated above, light weight balls, are not desirable due to their high trajectory, wind, stability etc.

Although balls produced utilizing this embodiment of the invention exhibit C.O.R. values within the desired C.O.R. range of about 0.590 to about 0.670 (i.e. 0.648), as a result of processing difficulties, this embodiment is somewhat less preferred than the butyl/polybutadiene mixtures set forth in Example 1 above.

EXAMPLE 3

As indicated above, the flight of golf balls produced according to the present invention is restricted by configuring the balls with an inefficient octahedral dimple pattern in addition to the use of low C.O.R. core compositions. In this regard, the ball illustrated in FIGS. 2–6 has an octahedral pattern with each hemisphere having a total of 168 dimples, making a total of 336 dimples ranged about the surface of the ball. All of the dimples have a diameter of substantially 0.128 inch and a depth of 0.0115 inch. With this configuration, substantially 48.65% of the surface of the ball is covered with dimples.

With these diameter and depth parameters, the following are the physical coordinates of each of the dimples in one hemisphere:

| DIMPLE NUMBER | LATITUDE Degrees | LATITUDE Minutes | LATITUDE Seconds | LONGITUDE Degrees | LONGITUDE Minutes | LONGITUDE Seconds |
|---|---|---|---|---|---|---|
| 1 | 7 | 49 | 30 | 45 | 0 | 0 |
| 2 | 7 | 49 | 30 | 135 | 0 | 0 |
| 3 | 7 | 49 | 30 | 225 | 0 | 0 |
| 4 | 7 | 49 | 30 | 315 | 0 | 0 |
| 5 | 17 | 30 | 45 | 18 | 21 | 30 |
| 6 | 17 | 30 | 45 | 71 | 38 | 30 |
| 7 | 17 | 30 | 45 | 108 | 21 | 30 |
| 8 | 17 | 30 | 45 | 161 | 38 | 30 |
| 9 | 17 | 30 | 45 | 198 | 21 | 30 |
| 10 | 17 | 30 | 45 | 251 | 38 | 30 |
| 11 | 17 | 30 | 45 | 288 | 21 | 30 |
| 12 | 17 | 30 | 45 | 341 | 38 | 30 |
| 13 | 23 | 31 | 0 | 45 | 0 | 0 |
| 14 | 23 | 31 | 0 | 135 | 0 | 0 |
| 15 | 23 | 31 | 0 | 225 | 0 | 0 |
| 16 | 23 | 31 | 0 | 315 | 0 | 0 |
| 17 | 28 | 23 | 30 | 11 | 30 | 0 |
| 18 | 28 | 23 | 30 | 78 | 30 | 0 |
| 19 | 28 | 23 | 30 | 101 | 30 | 0 |
| 20 | 28 | 23 | 30 | 168 | 30 | 0 |
| 21 | 28 | 23 | 30 | 191 | 30 | 0 |
| 22 | 28 | 23 | 30 | 258 | 30 | 0 |
| 23 | 28 | 23 | 30 | 281 | 30 | 0 |
| 24 | 28 | 23 | 30 | 248 | 30 | 0 |
| 25 | 32 | 43 | 30 | 32 | 6 | 30 |
| 26 | 32 | 43 | 30 | 57 | 53 | 30 |
| 27 | 32 | 43 | 30 | 122 | 6 | 30 |
| 28 | 32 | 43 | 30 | 147 | 53 | 30 |
| 29 | 32 | 43 | 30 | 212 | 6 | 30 |
| 30 | 32 | 43 | 30 | 237 | 53 | 30 |
| 31 | 32 | 43 | 30 | 302 | 6 | 30 |
| 32 | 32 | 43 | 30 | 327 | 53 | 30 |
| 33 | 39 | 37 | 0 | 8 | 35 | 0 |
| 34 | 39 | 37 | 0 | 81 | 25 | 0 |
| 35 | 39 | 37 | 0 | 98 | 35 | 0 |
| 36 | 39 | 37 | 0 | 171 | 25 | 0 |
| 37 | 39 | 37 | 0 | 188 | 35 | 0 |
| 38 | 39 | 37 | 0 | 261 | 25 | 0 |
| 39 | 39 | 37 | 0 | 278 | 35 | 0 |
| 40 | 39 | 37 | 0 | 351 | 25 | 0 |
| 41 | 42 | 2 | 30 | 45 | 0 | 0 |
| 42 | 42 | 2 | 30 | 135 | 0 | 0 |
| 43 | 42 | 2 | 30 | 225 | 0 | 0 |
| 44 | 42 | 2 | 30 | 315 | 0 | 0 |
| 45 | 42 | 26 | 0 | 25 | 13 | 0 |
| 46 | 42 | 26 | 0 | 64 | 47 | 0 |
| 47 | 42 | 26 | 0 | 115 | 13 | 0 |
| 48 | 42 | 26 | 0 | 154 | 47 | 0 |
| 49 | 42 | 26 | 0 | 205 | 13 | 0 |
| 50 | 42 | 26 | 0 | 244 | 47 | 0 |
| 51 | 42 | 26 | 0 | 295 | 13 | 0 |
| 52 | 42 | 26 | 0 | 334 | 47 | 0 |
| 53 | 50 | 51 | 0 | 7 | 4 | 0 |
| 54 | 50 | 51 | 0 | 82 | 56 | 0 |
| 55 | 50 | 51 | 0 | 97 | 4 | 0 |
| 56 | 50 | 51 | 0 | 172 | 56 | 0 |
| 57 | 50 | 51 | 0 | 187 | 4 | 0 |
| 58 | 50 | 51 | 0 | 262 | 56 | 0 |
| 59 | 50 | 51 | 0 | 277 | 4 | 0 |
| 60 | 50 | 51 | 0 | 352 | 56 | 0 |
| 61 | 51 | 28 | 0 | 37 | 14 | 0 |
| 62 | 51 | 28 | 0 | 52 | 46 | 0 |
| 63 | 51 | 28 | 0 | 127 | 14 | 0 |
| 64 | 51 | 28 | 0 | 142 | 46 | 0 |
| 65 | 51 | 28 | 0 | 217 | 14 | 0 |
| 66 | 51 | 28 | 0 | 232 | 46 | 0 |
| 67 | 51 | 28 | 0 | 307 | 14 | 0 |
| 68 | 51 | 28 | 0 | 322 | 46 | 0 |
| 69 | 52 | 24 | 30 | 21 | 17 | 0 |
| 70 | 52 | 24 | 30 | 68 | 43 | 0 |
| 71 | 52 | 24 | 30 | 111 | 17 | 0 |
| 72 | 52 | 24 | 30 | 158 | 43 | 0 |

-continued

| DIMPLE NUMBER | LATITUDE Degrees | LATITUDE Minutes | LATITUDE Seconds | LONGITUDE Degrees | LONGITUDE Minutes | LONGITUDE Seconds |
|---|---|---|---|---|---|---|
| 73 | 52 | 24 | 30 | 201 | 17 | 0 |
| 74 | 52 | 24 | 30 | 248 | 43 | 0 |
| 75 | 52 | 24 | 30 | 291 | 17 | 0 |
| 76 | 52 | 24 | 30 | 338 | 43 | 0 |
| 77 | 61 | 57 | 30 | 6 | 11 | 30 |
| 78 | 61 | 57 | 30 | 32 | 34 | 0 |
| 79 | 61 | 57 | 30 | 45 | 0 | 0 |
| 80 | 61 | 57 | 30 | 57 | 26 | 0 |
| 81 | 61 | 57 | 30 | 83 | 49 | 0 |
| 82 | 61 | 57 | 30 | 96 | 11 | 30 |
| 83 | 61 | 57 | 30 | 122 | 34 | 0 |
| 84 | 61 | 57 | 30 | 135 | 0 | 0 |
| 85 | 61 | 57 | 30 | 147 | 26 | 0 |
| 86 | 61 | 57 | 30 | 173 | 49 | 0 |
| 87 | 61 | 57 | 30 | 186 | 11 | 30 |
| 88 | 61 | 57 | 30 | 212 | 34 | 0 |
| 89 | 61 | 57 | 30 | 225 | 0 | 0 |
| 90 | 61 | 57 | 30 | 237 | 26 | 0 |
| 91 | 61 | 57 | 30 | 263 | 49 | 0 |
| 92 | 61 | 57 | 30 | 276 | 11 | 30 |
| 93 | 61 | 57 | 30 | 302 | 34 | 0 |
| 94 | 61 | 57 | 30 | 315 | 0 | 0 |
| 95 | 61 | 57 | 30 | 327 | 26 | 0 |
| 96 | 61 | 57 | 30 | 353 | 49 | 0 |
| 97 | 62 | 56 | 30 | 18 | 49 | 30 |
| 98 | 62 | 56 | 30 | 71 | 10 | 30 |
| 99 | 62 | 56 | 30 | 108 | 49 | 30 |
| 100 | 62 | 56 | 30 | 161 | 10 | 30 |
| 101 | 62 | 56 | 30 | 198 | 49 | 30 |
| 102 | 62 | 56 | 30 | 251 | 10 | 30 |
| 103 | 62 | 56 | 30 | 288 | 49 | 30 |
| 104 | 62 | 56 | 30 | 341 | 10 | 30 |
| 105 | 73 | 16 | 0 | 5 | 42 | 30 |
| 106 | 73 | 16 | 0 | 17 | 33 | 0 |
| 107 | 73 | 16 | 0 | 28 | 32 | 0 |
| 108 | 73 | 16 | 0 | 39 | 30 | 30 |
| 109 | 73 | 16 | 0 | 50 | 29 | 30 |
| 110 | 73 | 16 | 0 | 61 | 28 | 0 |
| 111 | 73 | 16 | 0 | 72 | 27 | 0 |
| 112 | 73 | 16 | 0 | 84 | 17 | 30 |
| 113 | 73 | 16 | 0 | 95 | 42 | 30 |
| 114 | 73 | 16 | 0 | 107 | 33 | 0 |
| 115 | 73 | 16 | 0 | 118 | 32 | 0 |
| 116 | 73 | 16 | 0 | 129 | 30 | 30 |
| 117 | 73 | 16 | 0 | 140 | 29 | 30 |
| 118 | 73 | 16 | 0 | 151 | 28 | 0 |
| 119 | 73 | 16 | 0 | 162 | 27 | 0 |
| 120 | 73 | 16 | 0 | 174 | 17 | 30 |
| 121 | 73 | 16 | 0 | 185 | 42 | 30 |
| 122 | 73 | 16 | 0 | 197 | 33 | 0 |
| 123 | 73 | 16 | 0 | 208 | 32 | 0 |
| 124 | 73 | 16 | 0 | 219 | 30 | 30 |
| 125 | 73 | 16 | 0 | 230 | 29 | 30 |
| 126 | 73 | 16 | 0 | 241 | 28 | 0 |
| 127 | 73 | 16 | 0 | 252 | 27 | 0 |
| 128 | 73 | 16 | 0 | 264 | 17 | 30 |
| 129 | 73 | 16 | 0 | 275 | 42 | 30 |
| 130 | 73 | 16 | 0 | 287 | 33 | 0 |
| 131 | 73 | 16 | 0 | 298 | 32 | 0 |
| 132 | 73 | 16 | 0 | 309 | 30 | 30 |
| 133 | 73 | 16 | 0 | 320 | 29 | 30 |
| 134 | 73 | 16 | 0 | 331 | 28 | 0 |
| 135 | 73 | 16 | 0 | 342 | 27 | 0 |
| 136 | 73 | 16 | 0 | 354 | 17 | 30 |
| 137 | 84 | 21 | 0 | 5 | 37 | 30 |
| 138 | 84 | 21 | 0 | 16 | 52 | 30 |
| 139 | 84 | 21 | 0 | 28 | 7 | 30 |
| 140 | 84 | 21 | 0 | 39 | 22 | 30 |
| 141 | 84 | 21 | 0 | 50 | 37 | 30 |
| 142 | 84 | 21 | 0 | 61 | 52 | 30 |
| 143 | 84 | 21 | 0 | 73 | 7 | 30 |
| 144 | 84 | 21 | 0 | 84 | 22 | 30 |
| 145 | 84 | 21 | 0 | 95 | 37 | 30 |
| 146 | 84 | 21 | 0 | 106 | 52 | 30 |
| 147 | 84 | 21 | 0 | 118 | 7 | 30 |
| 148 | 84 | 21 | 0 | 129 | 22 | 30 |
| 149 | 84 | 21 | 0 | 140 | 37 | 30 |
| 150 | 84 | 21 | 0 | 151 | 52 | 30 |

-continued

| DIMPLE NUMBER | LATITUDE Degrees | Minutes | Seconds | LONGITUDE Degrees | Minutes | Seconds |
|---|---|---|---|---|---|---|
| 151 | 84 | 21 | 0 | 163 | 7 | 30 |
| 152 | 84 | 21 | 0 | 174 | 22 | 30 |
| 153 | 84 | 21 | 0 | 185 | 37 | 30 |
| 154 | 84 | 21 | 0 | 196 | 52 | 30 |
| 155 | 84 | 21 | 0 | 208 | 7 | 30 |
| 156 | 84 | 21 | 0 | 219 | 22 | 30 |
| 157 | 84 | 21 | 0 | 230 | 37 | 30 |
| 158 | 84 | 21 | 0 | 241 | 52 | 30 |
| 159 | 84 | 21 | 0 | 253 | 7 | 30 |
| 160 | 84 | 21 | 0 | 264 | 22 | 30 |
| 161 | 84 | 21 | 0 | 275 | 37 | 30 |
| 162 | 84 | 21 | 0 | 286 | 52 | 30 |
| 163 | 84 | 21 | 0 | 298 | 7 | 30 |
| 164 | 84 | 21 | 0 | 309 | 22 | 30 |
| 165 | 84 | 21 | 0 | 320 | 37 | 30 |
| 166 | 84 | 21 | 0 | 331 | 52 | 30 |
| 167 | 84 | 21 | 0 | 343 | 7 | 30 |
| 168 | 84 | 21 | 0 | 354 | 22 | 30 |

Test results have shown that with this particular dimple arrangement, the driving distance of balls produced with standard C.O.R. value compositions have been reduced to the point that they are approximately 20 yards shorter than current driving range balls. See the results exhibited by ball "A" in comparison to that exhibited by ball "E" in Example 2. The trajectory, while being somewhat elevated, still provides the golfer with adequate feel and consistency to allow him to determine the results of his drives on the practice range. Further, as exhibited in Example 1, this inefficient dimple pattern in combination with the low C.O.R. value compositions of the invention (i.e. ball "C"), exhibit a reduction in total driving distance of approximately 45-50 yards.

The invention has been described with reference to the preferred embodiments. Obviously, modifications and alterations will occur to others upon a reading and understanding of the preceding detailed description. It is intended that the invention be construed as to include all such alterations and modifications insofar as they come within the scope of the claims and the equivalents thereof.

Having thus described the preferred embodiments, the invention is now claimed to be:

1. A restricted flight golf ball having a coefficient of restitution of 0.670 or less, a Riehle compression from 0.040 to 0.070 inches, a weight from 45.0 to 46.0 grams, and a diameter from 1.67 to 1.69 inches.

2. The restricted flight golf ball of claim 1, wherein the coefficient of restitution of said ball is about 0.620.

3. The restricted flight golf ball of claim 1, wherein the coefficient of restitution of said ball is about 0.650.

4. The restricted flight golf ball of claim 1, wherein the Riehle compression of said ball is about 0.050 inches.

5. A restricted flight golf ball comprising a core and a cover, wherein the core exhibits a coefficient of restitution from 0.560 to 0.640 and the cover exhibits a coefficient of restitution from 0.020 to 0.030, and wherein the ball has a Riehle compression from 0.040 to about 0.070 inches, a weight from 46.0 grams, and a diameter from 1.67 to 1.69 inches.

6. The restricted flight golf ball as defined in claim 5, wherein said cover is configured in an inefficient dimple pattern.

7. The restricted flight golf ball as defined in claim 5, wherein said cover is configured with dimples having a maximum dimple surface coverage area of 49%.

8. The restricted flight golf ball of claim 6, wherein the inefficient dimple pattern comprises of a dimple-free equator dividing the ball into two hemispheres, each having a pole, with the dimple pattern of each hemisphere being substantially identical, each of said hemispheres having a dimple pattern comprising;

four substantially identical equilateral triangles, with one side of each triangle comprising a first plurality of dimples adjacent to and parallel with said equator;

a dimple at the apex of each triangle opposite said one side and adjacent said pole of said hemisphere;

a second plurality of dimples extending along the other legs of said triangles;

a third plurality of dimples between said legs of said triangles;

the area of said dimples covering less than fifty per cent of the surface of said ball; and the depth d of each of said dimples being between 0.0110 and 0.0120 inch.

9. The golf ball of claim 5, wherein the diameter D of said dimples is between 0.123 and 0.129 inch.

10. The golf ball of claim 5, wherein each of said hemispheres has 168 dimples on its surface.

11. The golf ball of claim 5, wherein the depth d of each dimple is substantially 0.0115 inch.

12. The golf ball of claim 5, wherein the diameter D of each of said dimples is substantially 0.128 inch.

* * * * *